US011804185B2

(12) United States Patent
Lee et al.

(10) Patent No.: US 11,804,185 B2
(45) Date of Patent: Oct. 31, 2023

(54) DISPLAY DEVICE AND DRIVING METHOD OF THE SAME

(71) Applicant: LG Display Co., Ltd., Seoul (KR)

(72) Inventors: Byung Jae Lee, Paju-si (KR); Jung Heo, Paju-si (KR); Da Hye Kwon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/980,047

(22) Filed: Nov. 3, 2022

(65) Prior Publication Data

US 2023/0197014 A1 Jun. 22, 2023

(30) Foreign Application Priority Data

Dec. 17, 2021 (KR) ..... 10-2021-0181915

(51) Int. Cl.
*G09G 3/3291* (2016.01)
*G09G 3/3233* (2016.01)
*G09G 3/20* (2006.01)

(52) U.S. Cl.
CPC ..... *G09G 3/3291* (2013.01); *G09G 3/2096* (2013.01); *G09G 3/3233* (2013.01); *G09G 2300/0828* (2013.01); *G09G 2310/0286* (2013.01); *G09G 2310/0291* (2013.01); *G09G 2320/043* (2013.01); *G09G 2320/0626* (2013.01); *G09G 2330/021* (2013.01)

(58) Field of Classification Search
None
See application file for complete search history.

(56) References Cited

U.S. PATENT DOCUMENTS 5,469,164 A * 11/1995 Kemp ..... H03M 1/687 341/145
6,157,360 A * 12/2000 Jeong ..... G09G 3/3688 345/98
6,549,196 B1 * 4/2003 Taguchi ..... G09G 3/3688 345/98
2004/0257252 A1 12/2004 Wei
2008/0297390 A1 * 12/2008 Ko ..... G09G 3/3685 341/144

(Continued)

FOREIGN PATENT DOCUMENTS

KR 1020040044529 A 5/2004
KR 100869858 B1 11/2008

(Continued)

*Primary Examiner* — Dorothy Harris
(74) *Attorney, Agent, or Firm* — Seed IP Law Group LLP

(57) ABSTRACT

Provided is a display device including a display panel configured to display an image, a data driving circuit configured to supply a data voltage to the display panel, and a timing controller configured to control the data driving circuit, in which the data driving circuit includes a first converter configured to divide and output a voltage based on a plurality of resistors, a gain circuit configured to selectively receive at least two different voltages from the first converter, and amplify voltages input through input terminals to output the voltages to at least two output terminals or output the voltages without amplification and without change, and a second converter configured to interpolate and output at least two voltages output from the gain circuit.

10 Claims, 13 Drawing Sheets

(56) References Cited

U.S. PATENT DOCUMENTS

| | | | | |
|---|---|---|---|---|
| 2009/0051575 | A1* | 2/2009 | Lee | H03M 1/682 341/144 |
| 2010/0134528 | A1 | 6/2010 | Kim et al. | |
| 2011/0096054 | A1* | 4/2011 | Cho | G09G 3/3685 345/87 |
| 2015/0091888 | A1* | 4/2015 | Min | G09G 3/3291 345/212 |
| 2017/0032754 | A1* | 2/2017 | Kim | G09G 3/3685 |
| 2017/0046993 | A1* | 2/2017 | Chang | G09G 3/2003 |
| 2019/0305730 | A1* | 10/2019 | Huang | G09G 3/3208 |

FOREIGN PATENT DOCUMENTS

| | | | |
|---|---|---|---|
| KR | 1020120124368 | A | 11/2012 |
| KR | 1020180014388 | A | 2/2018 |

* cited by examiner

DISPLAY DEVICE AND DRIVING METHOD OF THE SAME

CROSS-REFERENCE TO RELATED APPLICATION

This application claims the benefit of and priority to Korean Patent Application No. 10-2021-0181915, filed on Dec. 17, 2021, which is hereby incorporated by reference as if fully set forth herein.

BACKGROUND

Technical Field

The present disclosure relates to a display device and a driving method of the same.

Description of the Related Art

With the development of information technology, the market for display devices, which are connection media between users and information, has been growing. Accordingly, there has been an increase in use of display devices such as a light-emitting display device (LED), a quantum dot display device (QDD), and a liquid crystal display device (LCD).

The display devices described above each include a display panel including subpixels, a driving unit configured to output a driving signal for driving the display panel, a power supply unit configured to generate power to be supplied to the display panel or the driving unit, etc.

In each of the display devices, when a driving signal, for example, a scan signal, a data signal, etc., is supplied to the subpixels formed in the display panel, an image may be displayed by a selected subpixel transmitting light or directly emitting light.

BRIEF SUMMARY

Accordingly, the present disclosure is directed to a display device and a driving method of the same that substantially obviate one or more problems due to limitations and disadvantages of the related art.

An aspect of the present disclosure is to reduce the size of a data driving circuit by minimizing the area occupied by a resistor and a wire included in a Digital-to-Analog converter (DA converter).

Additional advantages, benefits, and features of the disclosure will be set forth in part in the description which follows and in part will become apparent to those having ordinary skill in the art upon examination of the following or may be learned from practice of the disclosure. The benefits and other advantages of the disclosure may be realized and attained by the structure particularly pointed out in the written description and claims hereof as well as the appended drawings.

To achieve these benefits and other advantages and in accordance with the purpose of the disclosure, as embodied and broadly described herein, a display device includes a display panel configured to display an image, a data driving circuit configured to supply a data voltage to the display panel, and a timing controller configured to control the data driving circuit, in which the data driving circuit includes a first converter configured to divide and output a voltage based on a plurality of resistors, a gain circuit configured to selectively receive at least two different voltages from the first converter, and amplify voltages input through input terminals to output the voltages to at least two output terminals or output the voltages without amplification and without change, and a second converter configured to interpolate and output at least two voltages output from the gain circuit.

The gain circuit may amplify and output a voltage or output the voltage without amplification and without change in response to a gain adjustment signal output from the timing controller.

The timing controller may generate the gain adjustment signal based on a data signal to be supplied to the data driving circuit and a compensation value for compensating for deterioration of elements included in the display panel.

The timing controller may analyze the data signal and the compensation value, compare an analyzed value with a reference value, and generate a logic low gain adjustment signal or generate a logic high gain adjustment signal according to a result thereof.

The gain circuit may amplify and output voltages input through input terminals or output the voltages without amplification and without change using a combination of at least one gain amplifier and at least two switches.

The first converter may include an n-bit (n being 4 to 6) resistor-DA converter, the gain circuit may include a j-times (j being 2 to 16) gain amplifier, and the second converter may include a 3-bit interpolation DA converter.

The timing controller may output the gain adjustment signal through a communication interface coupled to the data driving circuit or a signal line separately connected to the data driving circuit.

In another aspect of the present disclosure, there is provided a method of driving a display device including a display panel configured to display an image, a data driving circuit configured to supply a data voltage to the display panel, and a timing controller configured to control the data driving circuit. The method includes generating a gain adjustment signal based on a data signal to be supplied to the data driving circuit and a compensation value for compensating for deterioration of elements included in the display panel, transmitting the gain adjustment signal to the data driving circuit, and controlling presence or absence of voltage amplification of a gain circuit included in a DA converter of the data driving circuit in response to the gain adjustment signal.

The generating may include analyzing the data signal and the compensation value, comparing an analyzed value with a reference value, and generating a logic low gain adjustment signal or generating a logic high gain adjustment signal according to a result thereof.

The gain circuit may amplify and output an input voltage in response to the logic high gain adjustment signal, and output an input voltage without amplification and without change in response to the logic low gain adjustment signal.

It is to be understood that both the foregoing description and the following detailed description of the present disclosure are explanatory and are intended to provide further explanation of the disclosure.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the embodiments of the present disclosure, examples of which are illustrated in the accompanying drawings. Wherever possible, the same reference numbers will be used throughout the drawings to refer to the same or like parts.

A display device according to the present disclosure may be implemented as a television, an image player, a personal computer (PC), a home theater, an automobile electric device, a smart phone, etc., and is not limited thereto. The display device according to the present disclosure may be implemented as an LED, a QDD, an LCD, etc.

However, hereinafter, for convenience of description, an LED that expresses an image by directly emitting light is given as an example. The LED may be implemented based on an inorganic light-emitting diode or an organic light emitting-diode. Hereinafter, for convenience of description, the LED implemented based on the organic light-emitting diode will be described as an example.

Figure 1:
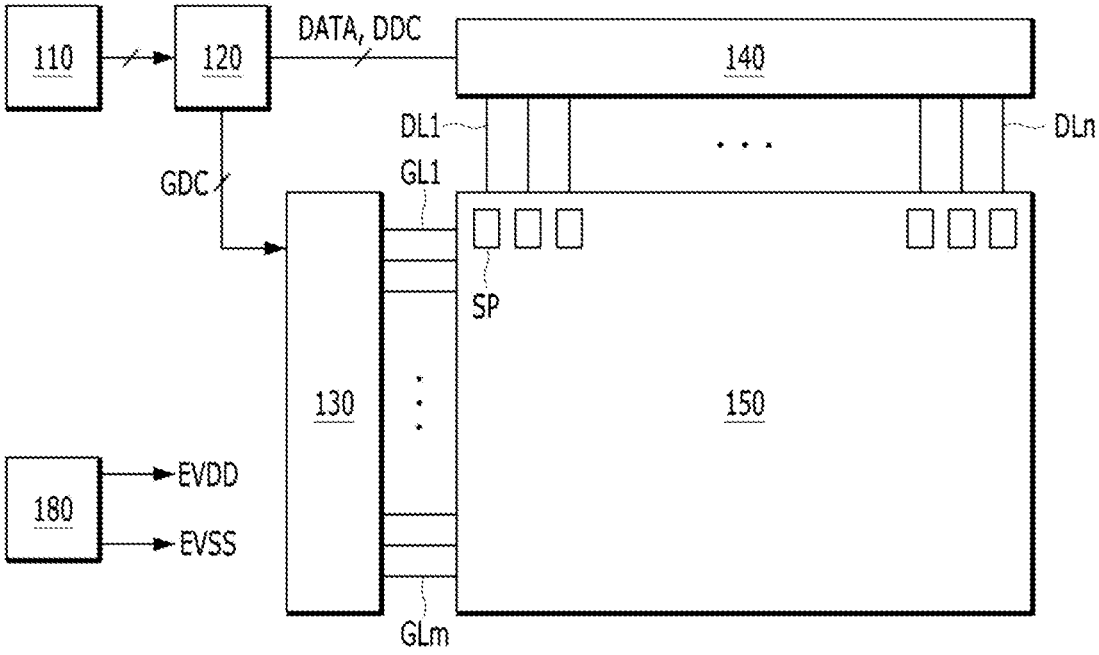
FIG. 1 is a block diagram schematically illustrating a configuration of an LED.
Figure 2:
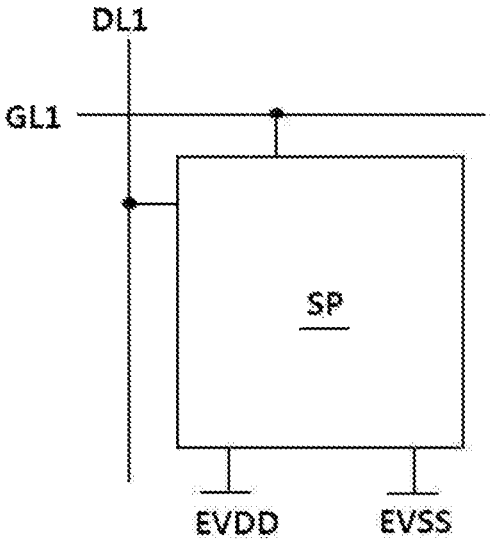
FIG. 2 is a block diagram schematically illustrating a subpixel included in a display panel.
Figure 3:
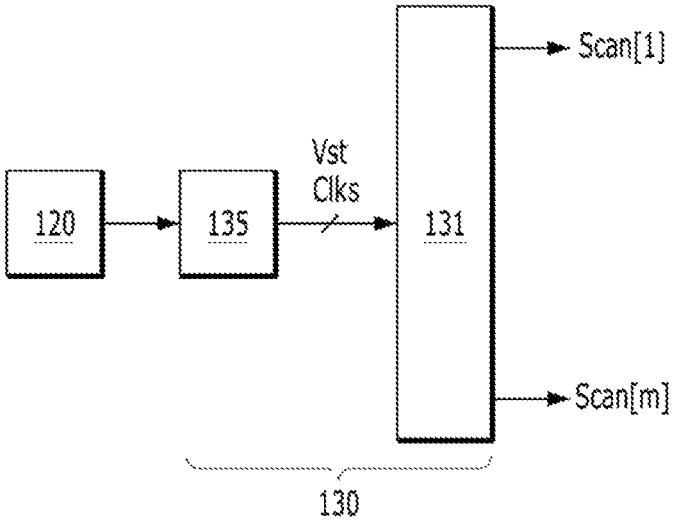
FIG. 3 is an example configuration of a device related to a gate-in-panel scan driving unit.
Figure 4A:
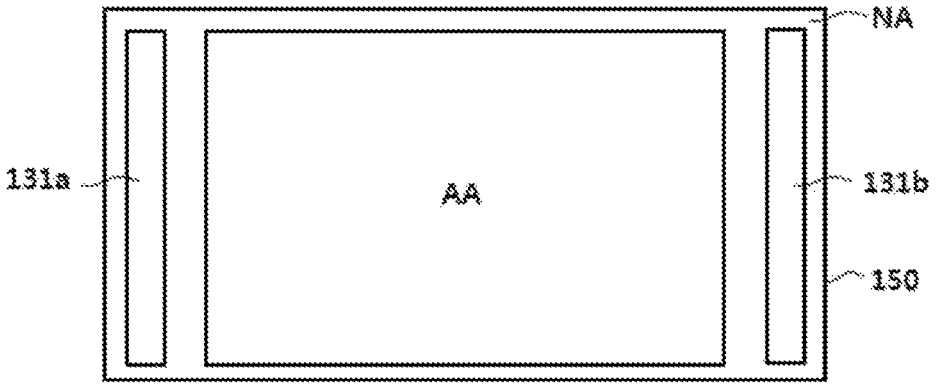
FIGS. 4A and 4B are example arrangement diagrams of the gate-in-panel scan driving unit.
Figure 4B:
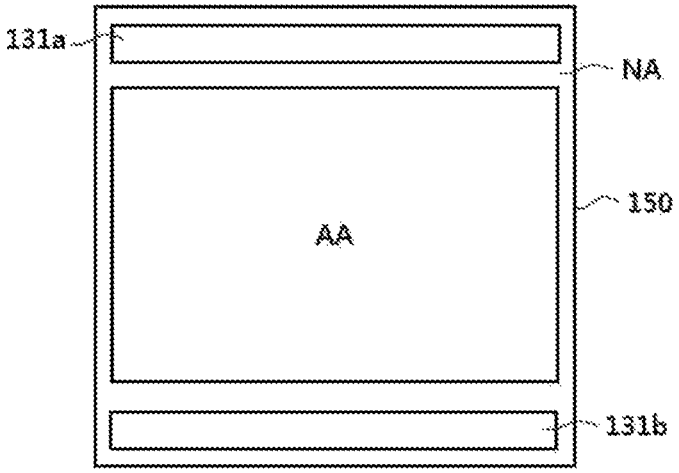
Figure 5:
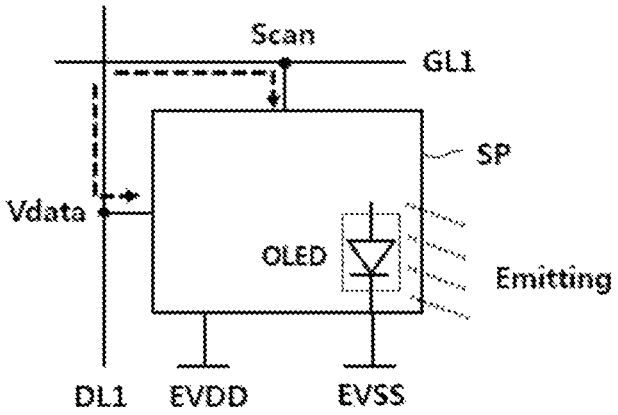
FIG. 5 is a diagram briefly illustrating a light-emitting operation of the subpixel.

FIG. 1 is a block diagram schematically illustrating a configuration of the LED, FIG. 2 is a block diagram schematically illustrating a subpixel included in a display panel, FIG. 3 is an example configuration of a device related to a gate-in-panel scan driving unit (or circuit), FIGS. 4A and 4B are example arrangement diagrams of the gate-in-panel scan driving unit (or circuit), and FIG. 5 is a diagram briefly illustrating a light-emitting operation of the subpixel. In each instance as used herein, a unit includes one or more circuits.

As illustrated in FIGS. 1 to 5, the LED may include an image supply unit, namely a circuit 110, a timing controller 120, a scan driving unit having a circuit 130, a data driving unit (circuit) 140, a display panel 150, a power supply unit comprised of a circuit 180, etc.

The image supply unit (or a host system) 110 may output various driving signals along with a data signal supplied from the outside or a data signal stored in an internal memory. The image supply unit 110 may supply a data signal and various driving signals to the timing controller 120.

The timing controller 120 may output a gate timing control signal GDC for controlling the operation timing of the scan driving unit 130, a data timing control signal DDC for controlling the operation timing of the data driving unit 140, various synchronization signals (Vsync, which is a vertical synchronization signal, and Hsync, which is a horizontal synchronization signal), etc. The timing controller 120 may supply a data signal DATA supplied from the image supply unit 110 together with the data timing control signal DDC to the data driving unit 140. The timing controller 120 may be formed as an integrated circuit (IC) and mounted on a printed circuit board, but is not limited thereto.

The power supply unit 180 may convert power supplied from the outside into first power having a high potential and second power having a low potential, and output the power through a first power line EVDD and a second power line EVSS under the control of the timing controller 120. The power supply unit 180 may generate and output a voltage necessary to drive the scan driving unit 130 (for example, a gate voltage including a gate high voltage and a gate low voltage) or a voltage necessary to drive the data driving unit 140 (a drain voltage including a drain voltage and a half-drain voltage) in addition to the first power and the second power.

The data driving unit 140 may sample and latch the data signal DATA in response to the data timing control signal DDC supplied from the timing controller 120, convert a digital data signal into an analog data voltage based on a gamma reference voltage, and output the analog data voltage. The data driving unit 140 may supply a data voltage to the subpixels included in the display panel 150 through data lines DL1 to DLn. The data driving unit 140 may be formed as an IC and mounted on the display panel 150 or mounted on a printed circuit board, but is not limited thereto.

The scan driving unit 130 may output a scan signal (or a scan voltage) in response to the gate timing control signal GDC supplied from the timing controller 120. The scan driving unit 130 may supply a scan signal to subpixels included in the display panel 150 through gate lines GL1 to GLm. The scan driving unit 130 may be formed as an IC or may be formed directly on the display panel 150 using a gate-in-panel method, but is not limited thereto.

The gate-in-panel type scan driving unit 130 may include a scan shift register 131 and a level shifter 135. The level shifter 135 may generate and output one or more of clock signals Clks and a start signal Vst based on signals output from the timing controller 120. The clock signals Clks may be generated and output in the form of K (K being an integer greater than or equal to 2) different phases, such as two-phase, four-phase, and eight-phase.

The scan shift register 131 may operate based on the signals Clks and Vst output from the level shifter 135, and output scan signals Scan[1] to Scan[m] capable of turning on or off a transistor formed on the display panel. The scan shift register 131 may be formed as a thin film on the display panel using a gate-in-panel method.

In general, the scan shift register 131 may be disposed in a non-display area NA of the display panel 150. In this instance, the scan shift register 131 may be disposed in left and right parts of the non-display area NA in the display panel 150 as illustrated in FIG. 4A, or may be disposed in upper and lower parts of the non-display area NA in the display panel 150 as illustrated in FIG. 4B.

Meanwhile, in FIGS. 4A and 4B, a first-side scan shift register 131*a* and a second-side scan shift register 131*b* are illustrated and described as being disposed in the non-display area NA located on the left and right sides or upper and lower sides of a display area AA as an example. However, the first-side scan shift register 131*a* and the second-side scan shift register 131*b* may be disposed on one of the left side, right side, upper side, or lower side. Alternatively, the scan shift register 131 may be dividedly disposed in the non-display area NA and the display area AA or may be distributed in only the display area AA.

In addition, unlike the scan shift register 131, the level shifter 135 may be formed as an independent IC or may be included in the power supply unit 180. However, this is only an example, and depending on the implementation method of the LED, one or more of the timing controller 120, the scan driving unit 130, and the data driving unit 140 may be implemented in various forms, such as being integrated into one IC.

The display panel 150 may operate in conjunction with the scan driving unit 130, the data driving unit 140, and the power supply unit 180, and display an image. The display panel 150 may be manufactured based on a substrate having rigidity or flexibility, such as glass, silicon, polyimide, etc. The display panel 150 may include subpixels that directly emit light (self-emission). The subpixels may include pixels including red, green, and blue or pixels including red, green, blue, and white.

One subpixel SP may be connected to the first data line DL1, the first gate line GL1, the first power line EVDD, and the second power line EVSS. One subpixel SP may include an organic light emitting diode (OLED) emitting light. One subpixel SP may include a switching transistor, a driving transistor, a capacitor, etc. One subpixel SP may cause the OLED to emit light based on a scan signal Scan, a data voltage Vdata, etc. Meanwhile, one subpixel may include a circuit for compensating for deterioration of the driving transistor in addition to the OLED.

Figure 6:
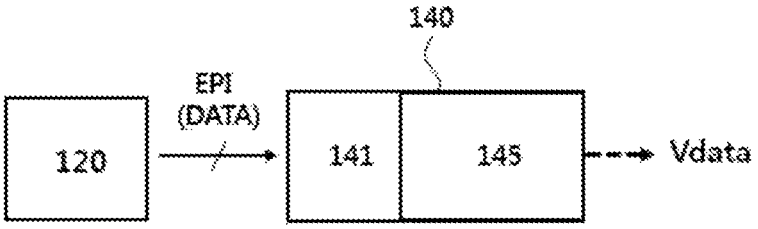
FIG. 6 is a diagram for describing a communication interface coupled between a timing controller and a data driving unit.
Figure 7:
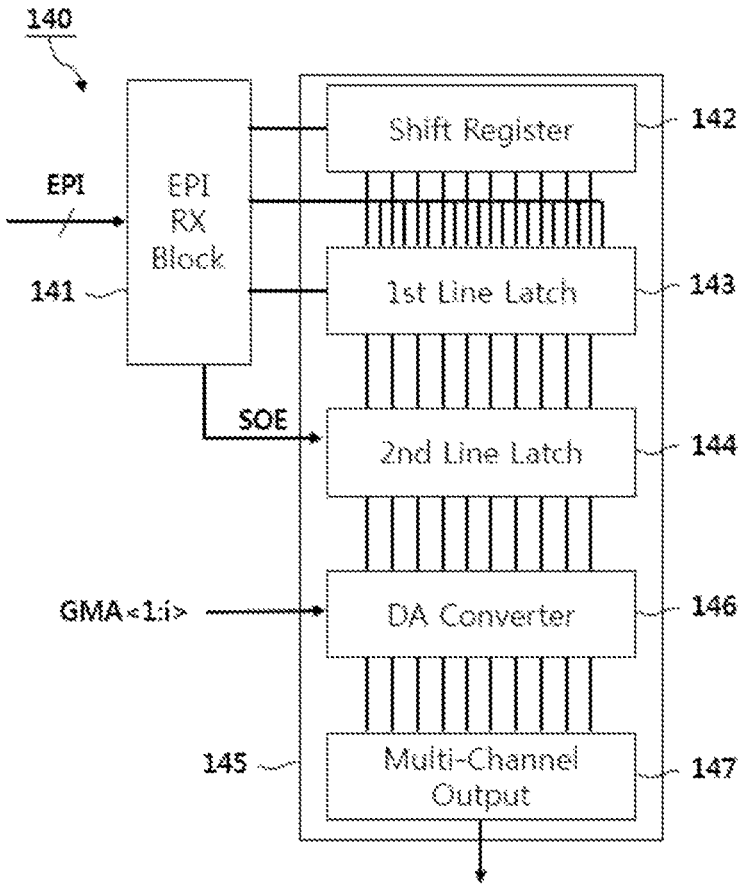
FIG. 7 is a block diagram schematically illustrating an internal block of the data driving unit.
Figure 8:
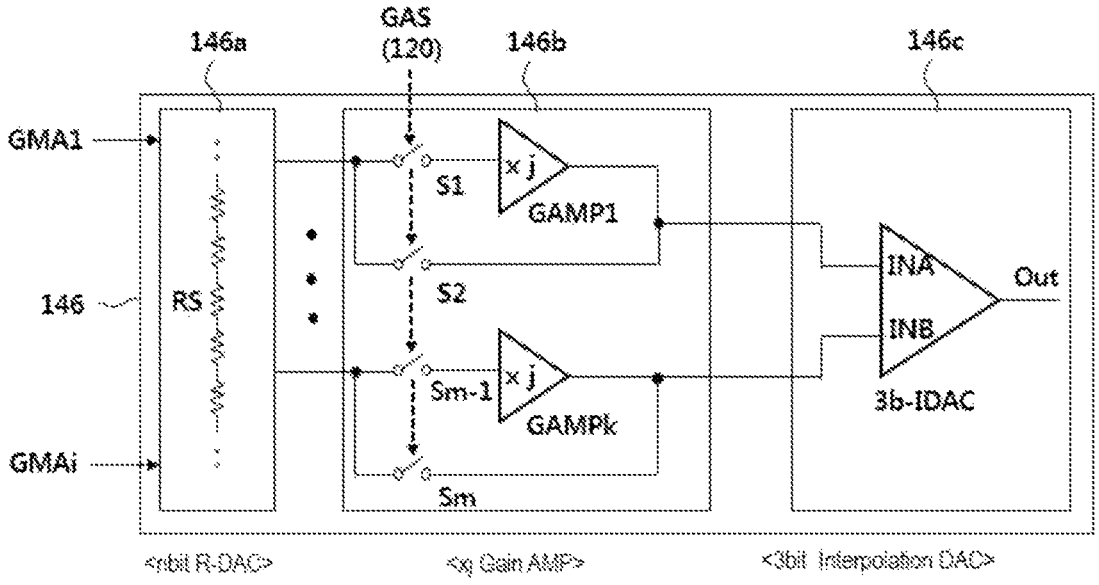
FIG. 8 is a circuit diagram illustrating a DA converter according to a first embodiment of the present disclosure.

FIG. 6 is a diagram for describing a communication interface coupled between the timing controller and the data driving unit, FIG. 7 is a block diagram schematically illustrating an internal block of the data driving unit, and FIG. 8 is a circuit diagram illustrating a DA converter according to a first embodiment of the present disclosure.

As illustrated in FIGS. 6 and 7, the data driving unit 140 may receive a digital data signal DATA based on a communication interface EPI coupled to the timing controller 120, convert the digital data signal DATA into an analog data voltage Vdata, and output the analog data voltage Vdata. Here, an embedded clock point-point interface (EPI) is coupled between the data driving unit 140 and the timing controller 120 as an example. However, the present disclosure is not limited thereto.

The data driving unit 140 may include a data receiver 141 (e.g., EPI RX Block) for receiving the data signal DATA from the timing controller 120, a data converter 145 for converting the received data signal DATA into a data voltage Vdata, etc.

The data converter 145 may include a shift register 142, a first latch 143 (e.g., 1st Line Latch), a second latch 144 (e.g., 2nd Line Latch), a DA converter 146, an output unit 147 (e.g., Multi-Channel Output), etc.

The shift register 142 may serve to generate a control signal so that a digital data signal transmitted from the timing controller 120 may be applied line by line. The first latch 143 may serve to sample and then output a digital data signal input from the outside under the control of the shift register 142. The first latch 143 may be referred to as a bar sampling latch serving to sample a data signal. The second latch 144 may serve to hold a digital data signal output from the first latch 143, and then output the data signal in response to a source output signal SOE. The second latch 144 may be referred to as a bar holding latch serving to hold (maintain) a data signal.

The DA converter 146 may serve to convert a digital data signal output from the second latch 144 into an analog data voltage, and then output the data voltage. The DA converter 146 may convert a digital data signal into an analog data voltage based on a gamma reference voltage GMA<1:i> output from a gamma unit. The output unit 147 may serve to output analog data voltages converted by the DA converter 146 through respective output channels. The data voltages output from the output unit 147 may be applied to the subpixels through data lines.

As illustrated in FIG. 8, the DA converter 146 according to the first embodiment of the present disclosure may include a first DA converter 146*a*, a gain circuit unit 146*b*, and a second DA converter 146*c*.

The first DA converter 146*a* may include a resistor string RS. The first DA converter 146*a* may divide and output a first gamma reference voltage GMA1 to an ith gamma reference voltage GMAi based on the resistor string RS including a plurality of resistors. The first DA converter 146*a* may be referred to as an n-bit resistor-DA converter (nbit R-DAC). Here, n may be 4 to 6, and i may be an integer of 6 or more.

The gain circuit unit 146*b* may include switches S1 to Sm and gain amplifiers GAMP1 to GAMPk. The gain circuit unit 146*b* may amplify voltages input through input terminals by j-times and output the voltages to an output terminal or output the voltages without amplification and without change by a combination of the at least one gain amplifier GAMP1 and at least two switches S1 and S2. The gain circuit unit 146*b* may be connected to voltage dividing nodes of resistors included in the first DA converter 146*a* to selectively receive at least two different voltages through input terminals. The gain circuit unit 146*b* may be referred to as a j-times gain amplifier (×j Gain AMP). Here, j may be 2 to 16, m may be an integer of 4 or more, and k may be an integer of 2 or more. Meanwhile, the switches S1 to Sm may be turned on or off in response to a gain adjustment signal GAS output from the timing controller 120. However, the present disclosure is not limited thereto.

The second DA converter 146*c* may interpolate at least two voltages input through two input terminals INA and INB in a 3-bit form and output the voltages to an output terminal. The second DA converter 146*c* may be referred to as a 3-bit interpolation DA converter (3-bit Interpolation DAC).

The n-bit resistor-DA converter (nbit R-DAC) and the j-times gain amplifier (×j Gain AMP) included in the DA converter 146 have a correlation to reduce the number of resistors and wires. For example, when implementing the DA converter 146 having a level similar to that of a 7-bit DA converter, the device may be configured using a 4-bit resistor-DA converter and a 16-times gain amplifier or a 6-bit resistor-DA converter and a 2-times gain amplifier. However, when the amplification multiple of the gain amplifier is increased instead of lowering the number of bits of the resistor-DA converter, complexity of the device may increase, which needs to be considered.

Figure 9:
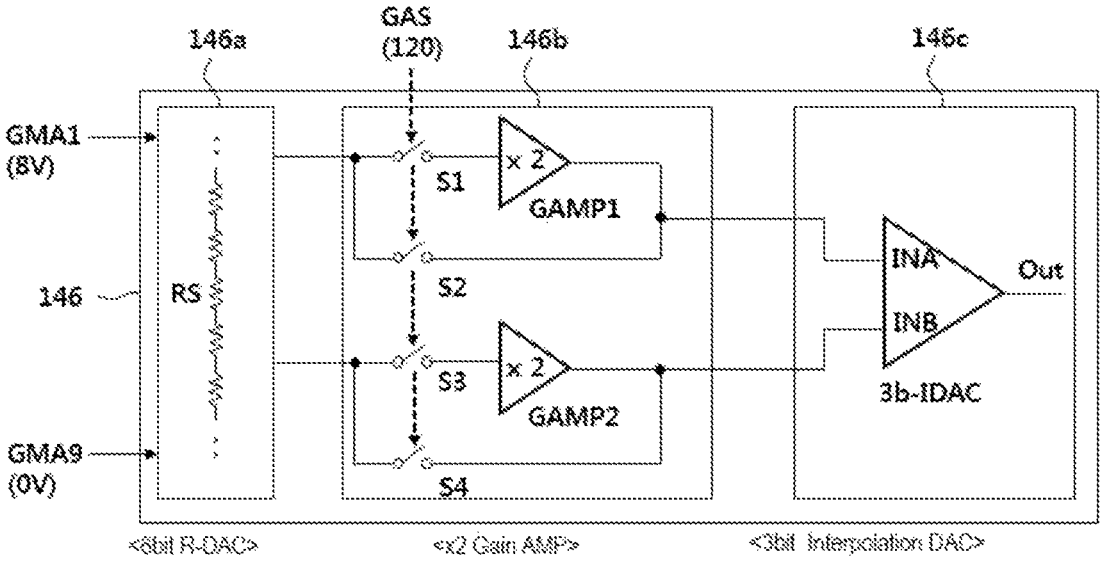
FIGS. 9 to 11 are circuit diagrams for describing implementation examples of the DA converter and operations thereof according to the first embodiment of the present disclosure.
Figure 10:
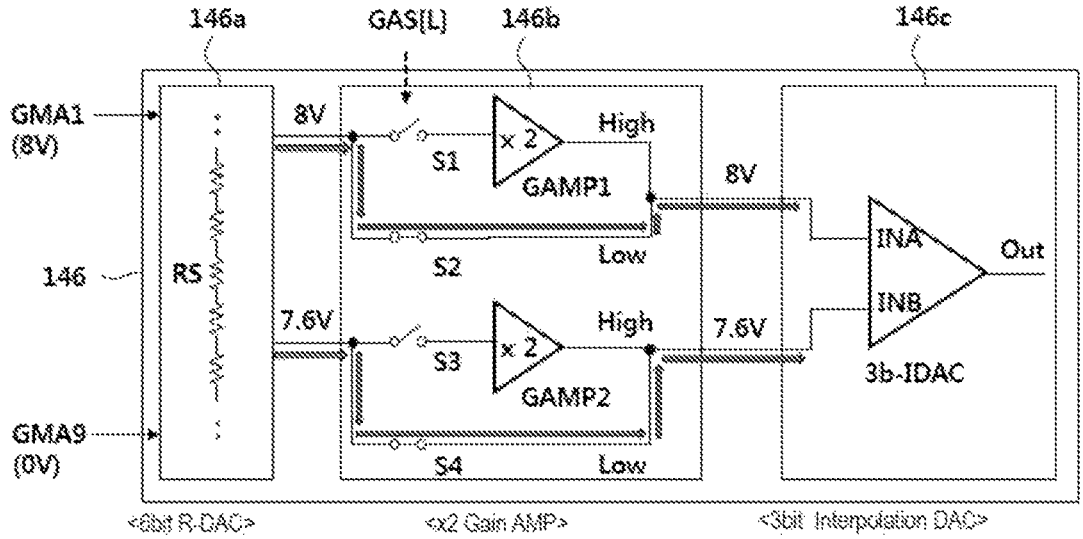
Figure 11:
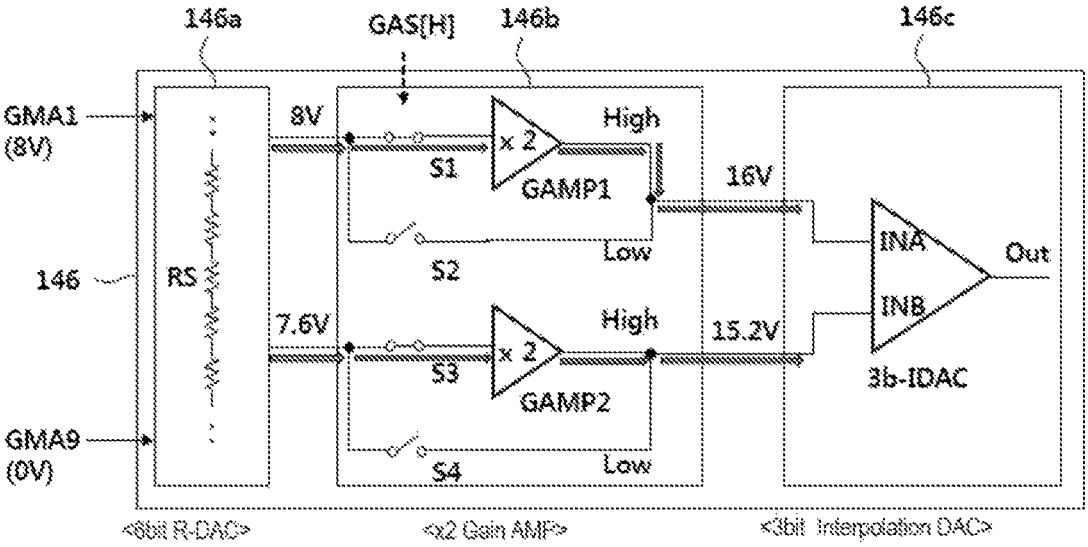
Figure 12:
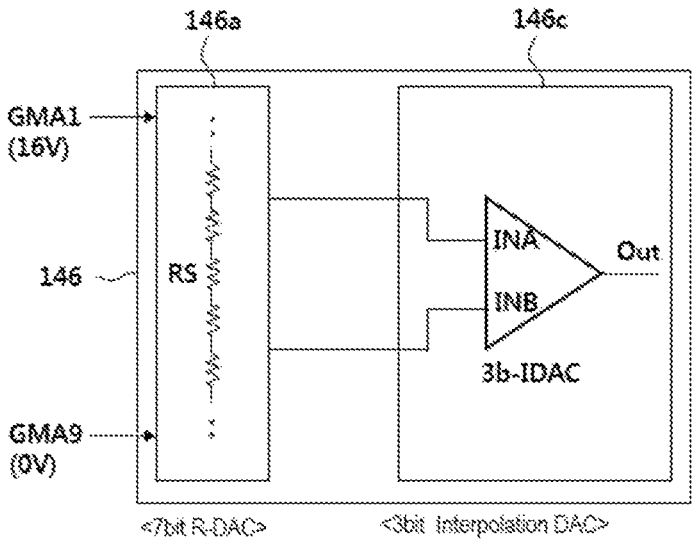
FIG. 12 is a circuit diagram illustrating a conventional DA converter.

FIGS. 9 to 11 are circuit diagrams for describing implementation examples of the DA converter and operations thereof according to the first embodiment of the present disclosure, and FIG. 12 is a circuit diagram illustrating a conventional DA converter.

According to the first embodiment of the present disclosure illustrated in FIG. 9, the first DA converter 146*a* may be set to a 6-bit resistor-DA converter (6 bit R-DAC), and the gain circuit unit 146*b* may be set to a double gain amplifier (×2 Gain AMP). In addition, the first DA converter 146*a* may receive the first gamma reference voltage GMA1 of 8 V to the ith gamma reference voltage GMAi of 0 V as a gamma tap voltage.

The 6-bit resistor-DA converter (6-bit R-DAC) set in the first DA converter 146*a* may be formed based on a resistor and a wire of 64ea. In addition, the double gain amplifier (×2 Gain AMP) set in the gain circuit unit 146*b* may be formed based on a combination of two gain amplifiers GAMP1 and GAMP2 and four switches S1 to S4 in order to amplify voltages input through two input terminals by 2 times and output the voltages to two output terminals or to output the voltages without amplification and without change.

As illustrated in FIG. 10, when a logic low gain adjustment signal GAS[L] is applied, the second switch S2 and the fourth switch S4 of the gain circuit unit 146*b* may be turned on, and the first switch S1 and the third switch S3 may be turned off. When the second switch S2 and the fourth switch S4 of the gain circuit unit 146*b* are turned on, a voltage of 8 V input to a first input terminal of the gain circuit unit 146*b* and a voltage of 7.6 V input to a second input terminal of the gain circuit unit 146*b* may be output without amplification and without change.

As illustrated in FIG. 11, when a logic high gain adjustment signal GAS[H] is applied, the first switch S1 and the third switch S3 of the gain circuit unit 146*b* may be turned on, and the second switch S2 and the fourth switch S4 of the gain circuit unit 146*b* may be turned off. When the first switch S1 and the third switch S3 of the gain circuit unit 146*b* are turned on, the voltage of 8 V input to the first input terminal of the gain circuit unit 146*b* may be amplified to a voltage of 16V and output, and the voltage of 7.6 V input to the input terminal may be amplified to a voltage of 15.2 V and output.

As illustrated in FIGS. 10 and 11, when the logic low gain adjustment signal GAS[L] is applied, the gain circuit unit 146*b* may output the voltage input through the input terminal without amplification and without change. On the other hand, when the logic high gain adjustment signal GAS[H] is applied, the gain circuit unit 146*b* may amplify and output the voltage input through the input terminal. However, this is only an example, and the present disclosure is not limited thereto.

As described above, the DA converter 146 according to the first embodiment of the present disclosure does not use an amplification function of the gain circuit unit 146*b* to output a voltage in a low voltage range (Low) corresponding to 0 V to 8 V, and may use the amplification function of the gain circuit unit 146*b* to output a voltage in a high voltage range (High) corresponding to 8 V to 12 V. By the above configuration and operation, the DA converter 146 according to the first embodiment of the present disclosure may reduce the size of the data driving unit while exhibiting a voltage resolution having a level similar to that of the 7-bit DA converter, which will be described as follows.

As illustrated in FIG. 12, in a conventional method, a 7-bit DA converter 146 is implemented based on a 7-bit resistor-DA converter (7-bit R-DAC) and a 3-bit interpolation DA DA converter (3-bit interpolation DAC). The conventional method is based on a 7-bit resistor-DA converter (7-bit R-DAC), and resistors and wires of 128ea may be required.

On the other hand, the first embodiment is based on a 6-bit resistor-DA converter (6 bit R-DAC), a double gain amplifier (×2 Gain AMP), etc., as illustrated in FIG. 9, and the resistors and wires of 128ea may be simplified to 64ea. Therefore, the DA converter 146 according to the first embodiment may provide an advantage in reducing the size of the data driving unit by minimizing the area occupied by the resistors and wires.

Figure 13:
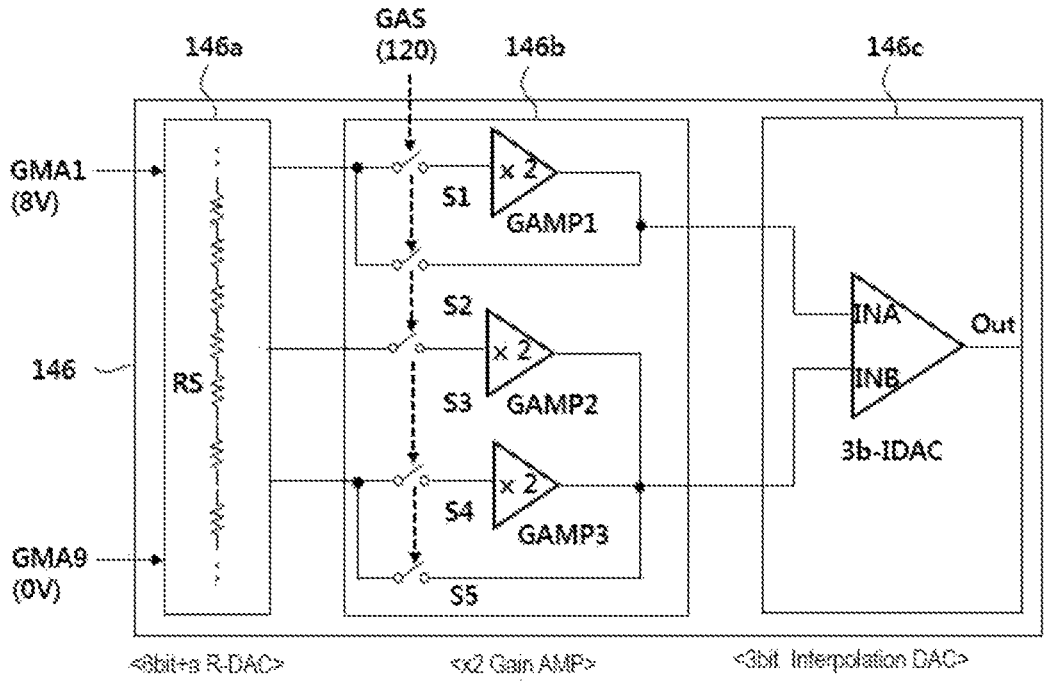
FIGS. 13 to 15 are circuit diagrams for describing implementation examples of a DA converter and operations thereof according to a second embodiment of the present disclosure.
Figure 14:
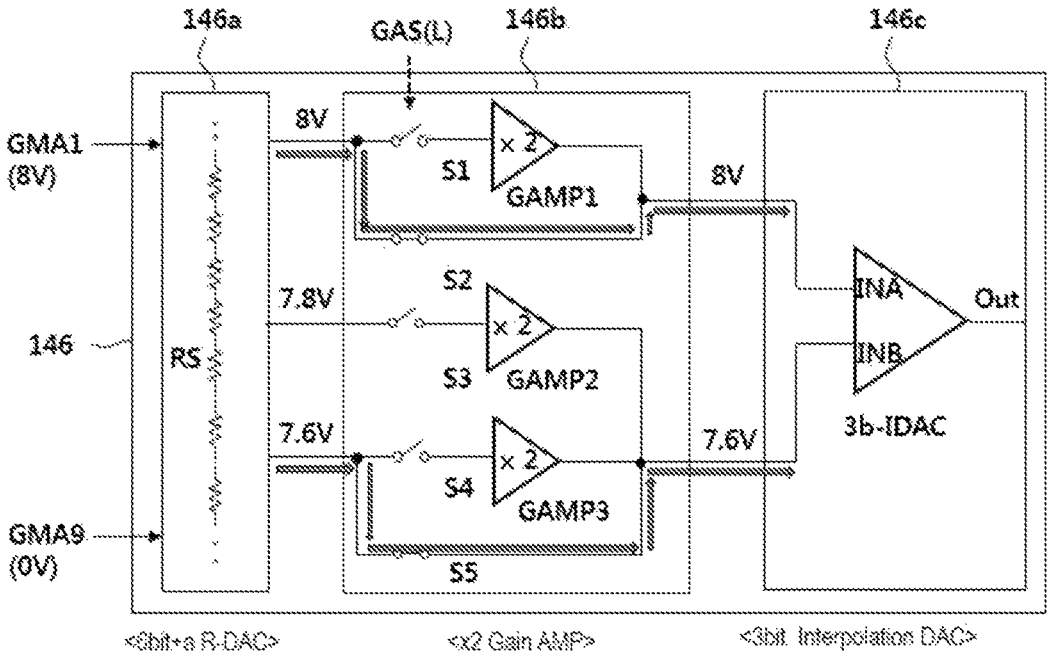
Figure 15:
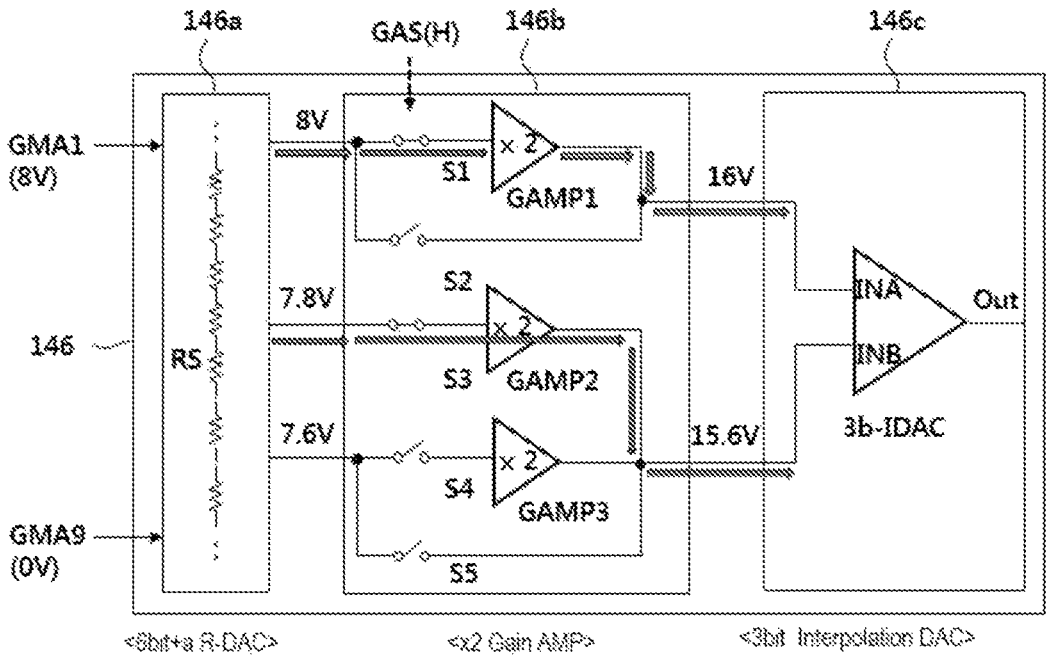

FIGS. 13 to 15 are circuit diagrams for describing an implementation example of a DA converter according to the second embodiment of the present disclosure and an operation thereof.

According to the second embodiment illustrated in FIG. 13, the first DA converter 146*a* may be set as a 6-bit+a resistor-DA converter (6 bit+a R-DAC), and the gain circuit unit 146*b* may be set as an amplifier (×2 Gain AMP). In addition, the first DA converter 146*a* may receive the first gamma reference voltage GMA1 of 8 V to the ith gamma reference voltage GMAi of 0 V as a gamma tap voltage.

The 6-bit+a resistor-DA converter (6 bit+a R-DAC) set in the first DA converter 146*a* may be formed based on resistors and wires of 96ea. In addition, the double gain amplifier (×2 Gain AMP) set in the gain circuit unit 146*b* may be formed based on a combination of three gain amplifiers GAMP1 to GAMP3 and five switches S1 to S5 in order to amplify voltages input through three input terminals by 2 times and output the voltages to two output terminals, or output the voltages without amplification.

Meanwhile, a reason for naming the resistor-DA converter included in the second embodiment as 6 bit+a is to emphasize that the voltage resolution may be further improved by being formed based on more resistors and wires of 96ea compared to the resistor-DA converter included in the first embodiment. As in the second embodiment, when voltages input through three input terminals are used by adding one input terminal between the two input terminals, it is possible to increase the voltage resolution in the high voltage range High. As a result, it is possible to improve the resolution for high luminance when expressing images.

As illustrated in FIG. 14, when the logic low gain adjustment signal GAS[L] is applied, the second switch S2 and the fifth switch S5 of the gain circuit unit 146*b* are turned on, and the first switch S1, the third switch S3, and the fourth switch S4 may be turned off. When the second switch S2 and the fifth switch S5 of the gain circuit unit 146*b* are turned on, a voltage of 8 V input to the first input terminal of the gain circuit unit 146*b* and a voltage of 7.6 V input to the third input terminal of the gain circuit unit 146*b* may be output without amplification and without change. On the other hand, a voltage of 7.8 V input to the second input terminal may not be output from the gain circuit unit 146*b* since there is no input/output path.

As illustrated in FIG. 15, when the logic high gain adjustment signal GAS[H] is applied, the first switch S1 and the third switch S3 of the gain circuit unit 146*b* may be turned on, and the second switch S2, the fourth switch S4, and the fifth switch S5 of the gain circuit unit 146*b* may be turned off. When the first switch S1 and the third switch S3 of the gain circuit unit 146*b* are turned on, the voltage of 8 V input to the first input terminal of the gain circuit unit 146*b* may be amplified to a voltage of 16V and output, and the voltage of 7.6 V input to the input terminal may be amplified to a voltage of 15.2 V and output. Meanwhile, the voltage of 7.6 V input to the third input terminal may not be output from the gain circuit unit 146*b* since there is no input/output path.

As illustrated in FIGS. 14 and 15, when the logic low gain adjustment signal GAS[L] is applied, the gain circuit unit 146*b* may output a voltage input through the input terminal without amplification and without change. On the other hand, when the logic high gain adjustment signal GAS[H] is applied, the gain circuit unit 146*b* may amplify and output the voltage input through the input terminal. However, this is only an example, and the present disclosure is not limited thereto.

As described above, the DA converter 146 according to the second embodiment of the present disclosure does not use the amplification function of the gain circuit unit 146*b* to output a voltage in a low voltage range Low corresponding to 0 V to 8 V, and may use the amplification function of the gain circuit unit 146*b* to output a voltage in a high voltage range High corresponding to 8 V to 12 V. By the above configuration and operation, the DA converter 146 according to the second embodiment of the present disclosure may reduce the size of the data driving unit while exhibiting a voltage resolution equivalent to that of the 7-bit DA converter.

In addition, the DA converter 146 according to the first and second embodiments of the present disclosure may easily implement low luminance (low luminance voltage) or high luminance (high luminance voltage) based on the gain adjustment signal output from the timing controller.

Figure 16:
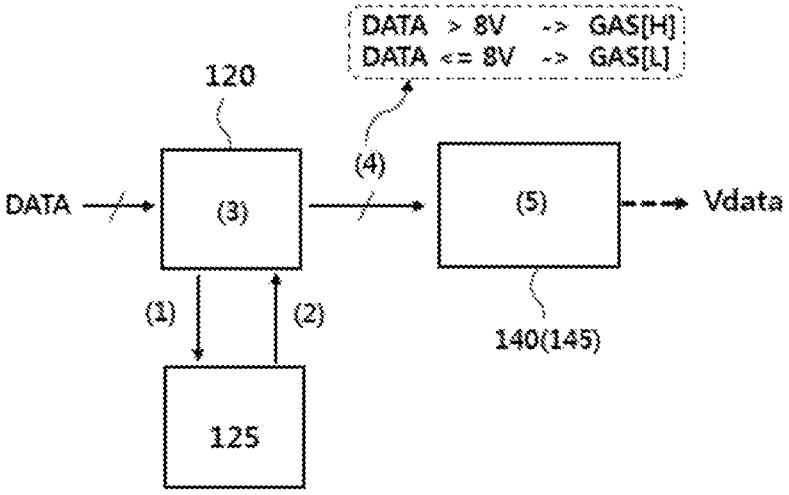
FIG. 16 is a block diagram illustrating a process of generating a gain adjustment signal using a timing controller according to a third embodiment of the present disclosure.
Figure 17:
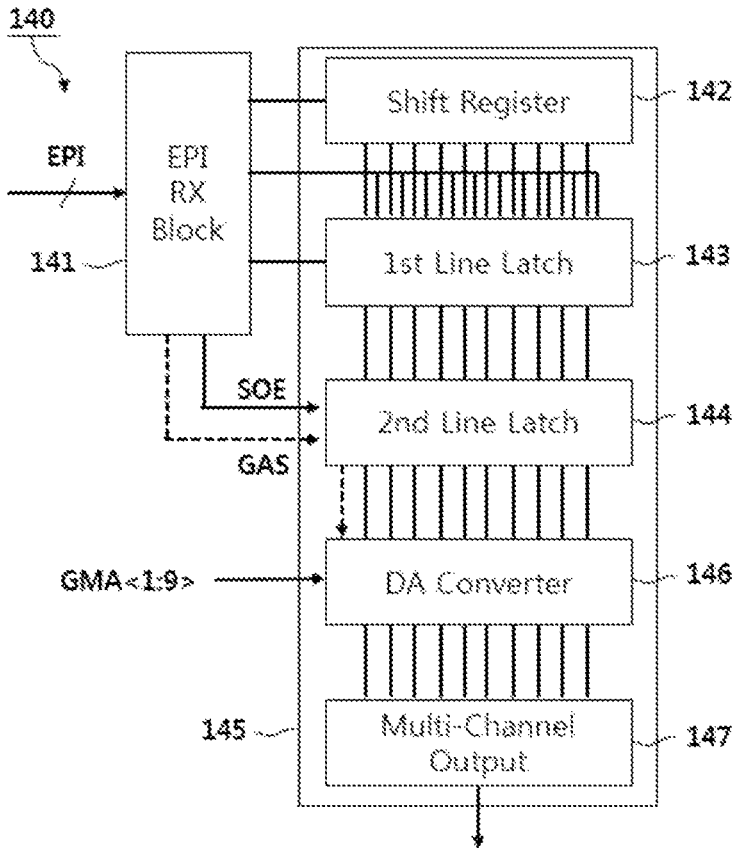
FIGS. 17 and 18 are block diagrams for describing a method of applying the gain adjustment signal to a data driving unit according to the third embodiment of the present disclosure.
Figure 18:
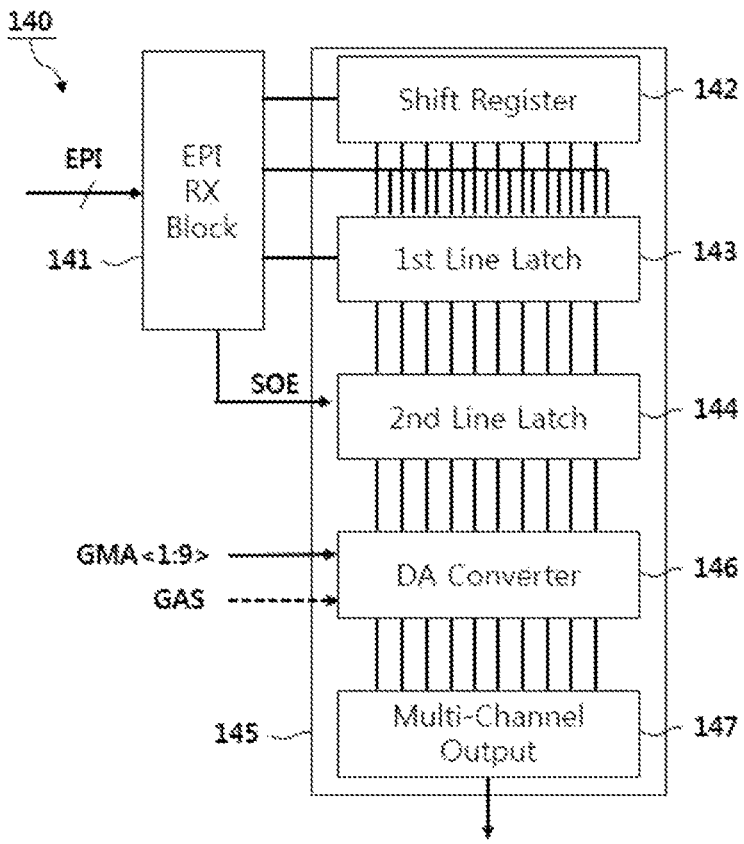

FIG. 16 is a block diagram illustrating a process of generating a gain adjustment signal using a timing controller according to a third embodiment of the present disclosure, and FIGS. 17 and 18 are block diagrams for describing a method of applying the gain adjustment signal to a data driving unit according to the third embodiment of the present disclosure.

As illustrated in FIG. 16, the timing controller 120 may generate the gain adjustment signal GAS to be applied to the data converter 145 of the data driving unit 140 based on the data signal DATA supplied from the outside, which will be described as follows.

First (1), the timing controller 120 may store the data signal DATA supplied from the outside in a memory 125 (frame memory; DDR). The data signal DATA may be stored in the memory 125 in units of one-frame data. One-frame data may include 30 bits including a red data signal, a green data signal, and a blue data signal, and 2 bits for controlling an algorithm of a current limit, etc. However, the present disclosure is not limited thereto.

Next (2), the timing controller 120 may fetch a compensation value for compensating for deterioration of elements included in the display panel together with the data signal DATA stored in the memory 125, and then add the compensation value to the data signal DATA.

Next (3), the timing controller 120 may analyze the data signal DATA and the compensation value (or compensation code value), compare an analyzed value with a reference value, and generate the logic low gain adjustment signal GAS[L] or the logic high gain adjustment signal GAS[H] according to a result thereof. For example, the timing controller 120 may generate the logic low gain adjustment signal GAS[L] when the data signal (10 bits [1023])+the compensation value is less than a reference value 512, and generate the logic high gain adjustment signal GAS[H] when the data signal (10 bits [1023])+the compensation value is greater than a reference value 512.

In brief, the timing controller 120 may generate the logic high gain adjustment signal GAS[H] upon determining that the data signal DATA has a voltage range higher than the voltage of 8 V, and may generate the logic low gain adjustment signal GAS[L] upon determining that the data signal DATA is equal to the voltage of 8 V or has a voltage range lower than the voltage of 8 V.

Next (4), the timing controller 120 may output the gain adjustment signal GAS prepared based on the data signal DATA and the compensation value through a communication interface coupled to the data driving unit 140 or a separate signal line.

Next (5), the data driving unit 140 may convert a digital data signal into an analog data voltage Vdata and output the analog data voltage Vdata while controlling the switches included in the gain circuit unit 146*b* of the data converter 145 based on the gain adjustment signal GAS applied from the timing controller 120.

As in a first example illustrated in FIG. 17, the data driving unit 140 may receive the gain adjustment signal GAS through the communication interface EPI coupled to the timing controller. The gain adjustment signal GAS may be transmitted to the data converter 145 through the data receiver 141 included in the data driving unit 140. Thereafter, the gain adjustment signal GAS may be applied to the switches included in the gain circuit unit of the DA converter 146 through the second latch 144. However, it should be noted that this is an example.

As in a second example illustrated in FIG. 18, the data driving unit 140 may receive the gain adjustment signal GAS through a separate signal line connected to the timing controller. The gain adjustment signal GAS may be directly applied to the switches included in the gain circuit unit of the DA converter 146. However, it should be noted that this is an example.

As described in the first example of FIG. 17 and the second example of FIG. 18, the gain adjustment signal GAS may be transmitted through the communication interface coupled between the timing controller and the data driving unit 140, and may be transmitted through a separate signal line prepared therebetween.

As described above, the present disclosure has an effect of reducing the size of the data driving unit by minimizing the area occupied by the resistors and wires included in the DA converter. In addition, the present disclosure has an effect of reducing the number of bits of the DA converter based on a method of controlling the gain amplifier and implementing low luminance (low luminance voltage) or high luminance (high luminance voltage). In addition, the present disclosure has an effect of selectively reducing the resistors and wires included in the DA converter according to an amplification ratio of the gain amplifier.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel configured to display an image;

a data driving circuit configured to supply a data voltage to the display panel; and a timing controller configured to control the data driving circuit, wherein the data driving circuit includes:

a first converter configured to divide and output a voltage based on a plurality of resistors;

a gain circuit configured to selectively receive at least two different voltages from the first converter, and amplify voltages input through input terminals to output the amplified voltages to at least two output terminals or output the at least two different voltages without amplification and without change; and a second converter configured to interpolate and output at least two voltages output from the gain circuit.

2. The display device according to claim 1, wherein the gain circuit amplifies and outputs a voltage or outputs the voltage without amplification and without change in response to a gain adjustment signal output from the timing controller.

3. The display device according to claim 2, wherein the timing controller generates the gain adjustment signal based on a data signal to be supplied to the data driving circuit and a compensation value for compensating for deterioration of elements included in the display panel.

4. The display device according to claim 3, wherein the timing controller analyzes the data signal and the compensation value, compares an analyzed value with a reference value, and generates a logic low gain adjustment signal or generates a logic high gain adjustment signal according to a comparing result.

5. The display device according to claim 1, wherein the gain circuit amplifies and outputs voltages input through input terminals or outputs the voltages input through input terminals without amplification and without change using a combination of at least one gain amplifier and at least two switches.

6. The display device according to claim 5, wherein:

the first converter includes an n-bit resistor-DA converter, wherein n is 4 to 6;

the gain circuit includes a j-times gain amplifier, wherein j is 2 to 16; and the second converter includes a 3-bit interpolation DA converter.

7. The display device according to claim 2, wherein the timing controller outputs the gain adjustment signal through a communication interface coupled to the data driving circuit or a signal line separately connected to the data driving circuit.

8. A method of driving a display device including a display panel configured to display an image, a data driving circuit configured to supply a data voltage to the display panel, and a timing controller configured to control the data driving circuit, the method comprising:

generating a gain adjustment signal based on a data signal to be supplied to the data driving circuit and a compensation value for compensating for deterioration of elements included in the display panel;

transmitting the gain adjustment signal to the data driving circuit; and controlling presence or absence of voltage amplification of a gain circuit included in a digital-to-analog converter of the data driving circuit in response to the gain adjustment signal.

9. The method according to claim 8, wherein the generating the gain adjustment signal includes analyzing the data signal and the compensation value, comparing an analyzed value with a reference value, and generating a logic low gain adjustment signal or generating a logic high gain adjustment signal according to a comparing result.

10. The method according to claim 9, wherein the gain circuit is disposed to amplify and output an input voltage in response to the logic high gain adjustment signal; and wherein the gain circuit is further disposed to outputs an input voltage without amplification and without change in response to the logic low gain adjustment signal.

* * * * *